US011592212B2

(12) United States Patent
Schreiber et al.

(10) Patent No.: US 11,592,212 B2
(45) Date of Patent: Feb. 28, 2023

(54) BYPASS LINE FOR REFRIGERANT

(71) Applicant: Johnson Controls Technology Company, Auburn Hills, MI (US)

(72) Inventors: Jeb William Schreiber, Stewartstown, PA (US); Seth Kevin Gladfelter, Red Lion, PA (US); Kevin Donald Krebs, Dallastown, PA (US)

(73) Assignee: Johnson Controls TYCO IP Holdings LLP, Milwaukee, WI (US)

( * ) Notice: Subject to any disclaimer, the term of this patent is extended or adjusted under 35 U.S.C. 154(b) by 46 days.

(21) Appl. No.: 17/258,728

(22) PCT Filed: Mar. 17, 2019

(86) PCT No.: PCT/US2019/021215

§ 371 (c)(1),
(2) Date: Jan. 7, 2021

(87) PCT Pub. No.: WO2020/013894

PCT Pub. Date: Jan. 16, 2020

(65) Prior Publication Data

US 2021/0156602 A1 May 27, 2021

Related U.S. Application Data

(63) Continuation of application No. 16/171,145, filed on Oct. 25, 2018, now Pat. No. 10,697,674.

(Continued)

(51) Int. Cl.
*F25B 49/02* (2006.01)
*F25B 39/04* (2006.01)

(Continued)

(52) U.S. Cl.
CPC ..... *F25B 1/00* (2013.01); *F25B 13/00* (2013.01); *F25B 39/04* (2013.01); *F25B 41/20* (2021.01);

(Continued)

(58) Field of Classification Search
CPC ..... F25B 49/027; F25B 2400/0411; F25B 2500/31; F25B 2600/0253; F25B 2600/05; F25B 2600/2501; F25B 2339/044

See application file for complete search history.

(56) References Cited

U.S. PATENT DOCUMENTS 3,013,404 A 12/1961 Endress et al.
3,141,311 A * 7/1964 McGrath ..... F25B 1/053 62/305

(Continued)

FOREIGN PATENT DOCUMENTS

CN 107131687 A 9/2017
GB 899074 A 6/1962

(Continued)

OTHER PUBLICATIONS

Chinese Office Action for CN Application No. 201980055846.6, dated Nov. 30, 2021, 7 pgs.

(Continued)

*Primary Examiner* — Jonathan Bradford
(74) *Attorney, Agent, or Firm* — Fletcher Yoder, P.C.

(57) ABSTRACT

A vapor compression system includes a first conduit fluidly coupling a liquid collection portion of a condenser and an evaporator, where the first conduit is configured to direct a first flow of refrigerant from the condenser to a first inlet of the evaporator and a second conduit fluidly coupling the liquid collection portion of the condenser and the evaporator, where the second conduit is configured to direct a second flow of refrigerant from the condenser to a second inlet of the evaporator via gravitational force, and where the first inlet is disposed above the second inlet relative to a vertical dimension of the evaporator.

19 Claims, 8 Drawing Sheets

Related U.S. Application Data

(60) Provisional application No. 62/696,276, filed on Jul. 10, 2018, provisional application No. 62/696,276, filed on Jul. 10, 2018.

(51) Int. Cl.

| | |
|---|---|
| ***F25B 1/00*** | (2006.01) |
| ***F25B 13/00*** | (2006.01) |
| ***F25B 41/20*** | (2021.01) |
| ***F25B 41/40*** | (2021.01) |

(52) U.S. Cl.

CPC ..... *F25B 41/40* (2021.01); *F25B 49/02* (2013.01); *F25B 49/027* (2013.01); *F25B 2400/0411* (2013.01); *F25B 2500/31* (2013.01); *F25B 2600/0253* (2013.01); *F25B 2600/05* (2013.01); *F25B 2600/2501* (2013.01)

(56) References Cited

U.S. PATENT DOCUMENTS

| | | | | | |
|---|---|---|---|---|---|
| 3,158,009 | A | * | 11/1964 | Rayner | F25B 31/008 62/505 |
| 3,191,396 | A | | 6/1965 | Ruddock | |
| 3,241,331 | A | * | 3/1966 | Endress | F25B 31/008 62/505 |
| 3,242,689 | A | | 3/1966 | Chubb et al. | |
| 3,270,521 | A | * | 9/1966 | Rayner | F25B 31/002 62/505 |
| 3,299,653 | A | * | 1/1967 | Osborne | F25B 1/053 62/115 |
| 3,744,273 | A | * | 7/1973 | Ware | F25B 1/053 62/149 |
| 4,832,068 | A | * | 5/1989 | Wendschlag | F25B 31/008 62/197 |
| 5,839,294 | A | * | 11/1998 | Chiang | F28D 21/0017 165/117 |

FOREIGN PATENT DOCUMENTS

| | | | |
|---|---|---|---|
| JP | H01169278 | A | 7/1989 |
| JP | 2000356421 | A | 12/2000 |
| JP | 2010230264 | A | 10/2010 |
| JP | 2012149782 | A | 8/2012 |
| WO | 2009135297 | A1 | 11/2009 |
| WO | 2019023267 | A1 | 1/2019 |

OTHER PUBLICATIONS

Japanese Office Action for JP Application No. 2021-500601, dated Feb. 2, 2022, 5 pgs.

International Search Report and Written Opinion for PCT Application No. PCT/US2019/021215, dated Jun. 3, 2019, 16 pgs.

* cited by examiner

BYPASS LINE FOR REFRIGERANT

CROSS-REFERENCE TO RELATED APPLICATIONS

This application claims priority from and the benefit of U.S. Provisional Application Ser. No. 62/696,276, entitled "BYPASS LINE FOR REFRIGERANT," filed Jul. 10, 2018, which is herein incorporated by reference in its entirety for all purposes.

BACKGROUND

This application relates generally to vapor compression systems, such as chillers, and more specifically to a bypass line or bypass conduit that fluidly connects a condenser and an evaporator.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Refrigeration systems are used in a variety of settings and for many purposes. For example, refrigeration systems may operate as a free cooling system and a mechanical cooling system. In some cases, the free cooling system may include a liquid-to-air heat exchanger, which is used in some heating, ventilating, and air conditioning applications. Additionally, the mechanical cooling system may be a vapor-compression refrigeration cycle, which may include a condenser, an evaporator, a compressor, and/or an expansion device. In the evaporator, liquid or primarily liquid refrigerant is evaporated by drawing thermal energy from an air flow stream and/or a cooling fluid (e.g., water), where the air flow stream may also flow through the liquid-to-air heat exchanger of the free cooling system. In the condenser, the refrigerant is de-superheated, condensed, and/or sub-cooled. Refrigerant flows through an expansion valve as it flows from the condenser to the evaporator. Under some operating conditions, a flow of refrigerant from the condenser to the evaporator may be limited or otherwise restricted.

SUMMARY

In an embodiment of the present disclosure, a vapor compression system includes a first conduit fluidly coupling a liquid collection portion of a condenser and an evaporator, where the first conduit is configured to direct a first flow of refrigerant from the condenser to a first inlet of the evaporator and a second conduit fluidly coupling the liquid collection portion of the condenser and the evaporator, where the second conduit is configured to direct a second flow of refrigerant from the condenser to a second inlet of the evaporator via gravitational force, and where the first inlet is disposed above the second inlet relative to a vertical dimension of the evaporator.

In an embodiment of the present disclosure, a vapor compression system includes a condenser configured to receive a refrigerant of the vapor compression system and place the refrigerant in a heat exchange relationship with a first working fluid, an evaporator fluidly coupled to the condenser via a primary conduit connected to the evaporator and a bypass conduit connected to the evaporator, where the evaporator is configured to place the refrigerant in a heat exchange relationship with a second working fluid, a valve disposed along the bypass conduit, and a controller configured to adjust a position of the valve based on feedback indicative of a pressure differential between the condenser and the evaporator.

In an embodiment of the present disclosure, a vapor compression system includes a condenser configured to receive a refrigerant from a compressor in a gaseous phase, where the condenser is configured to condense the refrigerant from the gaseous phase into a liquid phase via heat transfer from the refrigerant to a first working fluid, an evaporator fluidly coupled to the condenser via a first conduit and via a second conduit, where the evaporator is configured to vaporize the refrigerant from the liquid phase into the gaseous phase via heat transfer from a second working fluid to the refrigerant, and a controller configured to regulate operation of the vapor compression system to direct the refrigerant into the evaporator via the first conduit, the second conduit, or both when a liquid refrigerant level in the condenser is outside of a threshold range of values.

DRAWINGS

DETAILED DESCRIPTION

Figure 1:
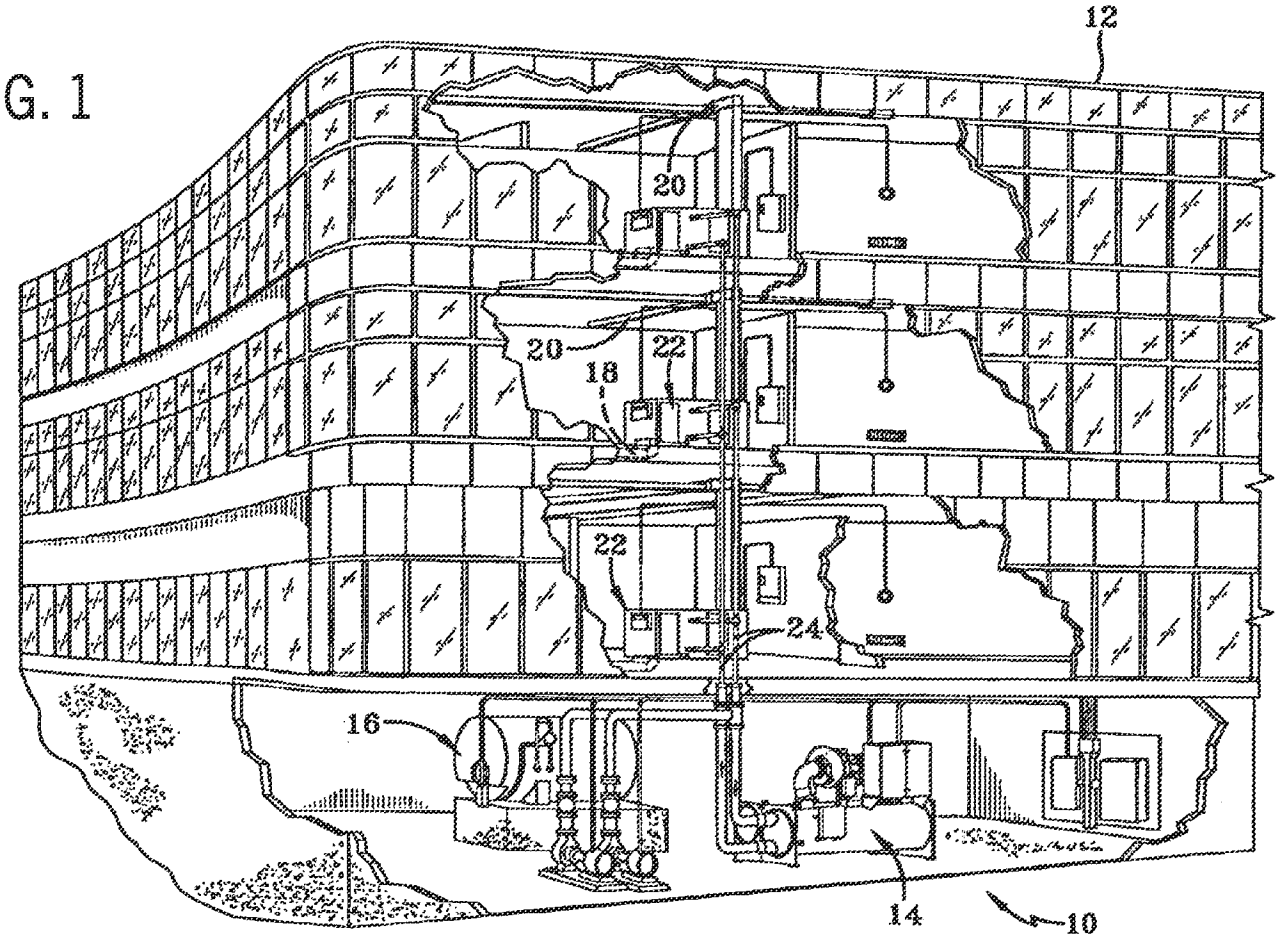
FIG. 1 is a perspective view of a building that may utilize an embodiment of a heating, ventilation, and air conditioning (HVAC) system in a commercial setting, in accordance with an aspect of the present disclosure.

As discussed above, a vapor compression system generally includes a refrigerant flowing through a refrigeration circuit. The refrigerant flows through multiple conduits and components disposed along the refrigeration circuit, while undergoing phase changes to enable the vapor compression system to condition an interior space of a structure. For example, a refrigerant transitions from a liquid phase to a vapor phase within an evaporator. Certain refrigerants, such as refrigerants having low vapor pressures, may not readily flow from a condenser to the evaporator when the differential pressure between the condenser and the evaporator is relatively low. More specifically, low vapor pressure refrigerants may stack up, or collect, within the conduit between the condenser and the evaporator and/or within the expansion valve. This may reduce an operational efficiency of the HVAC system.

Some examples of fluids that may be used as refrigerants in embodiments of the vapor compression system of the present disclosure are hydrofluorocarbon (HFC) based refrigerants, for example, R-410A, R-407, R-134a, hydrofluoro olefin (HFO), "natural" refrigerants, such as ammonia ($NH_3$), R-717, carbon dioxide ($CO_2$), R-744, or hydrocarbon based refrigerants, water vapor, or any other suitable refrigerant. In some embodiments, the vapor compression system may be configured to efficiently utilize refrigerants having a normal boiling point of about 19 degrees Celsius (66 degrees Fahrenheit) at one atmosphere of pressure, also referred to as low pressure refrigerants, as compared to a medium pressure refrigerant, such as R-134a. As used herein, "normal boiling point" may refer to a boiling point temperature measured at one atmosphere of pressure.

The present disclosure is directed to a bypass line between a condenser and an evaporator. In some embodiments, the bypass line is a secondary conduit that fluidly couples the condenser to the evaporator. For example, the bypass line (e.g., refrigerant liquid bypass conduit or secondary conduit) is fluidly coupled to a liquid collection portion of the condenser to enable a flow of substantially liquid refrigerant (e.g., at least 75% liquid by volume, at least 90% liquid by volume, at least 95% liquid by volume, or at least 99% liquid by volume) from the condenser to the evaporator. In other embodiments, the bypass line is fluidly coupled to a primary conduit between the evaporator and the condenser. In any case, the secondary conduit may be configured to facilitate a flow of liquid refrigerant (e.g., at least 75% by volume liquid, at least 90% by volume liquid, at least 95% by volume liquid, or at least 99% volume by liquid) from the condenser to the evaporator. For instance, the bypass conduit may be angled or otherwise positioned to enable gravity to at least partially force a portion of the refrigerant from the condenser to the evaporator. Additionally, in some embodiments, a pressure head of refrigerant in the condenser may also contribute to directing the flow of refrigerant through the bypass line.

The bypass conduit may include a valve to regulate an amount of refrigerant flowing through the bypass conduit. The valve may be opened partially or completely based at least in part on feedback indicative of a pressure differential between the condenser and the evaporator. For example, the feedback indicative of the pressure differential between the condenser and the evaporator may be based on refrigerant "stacking" in the primary conduit, such as a refrigerant level measurement or detection in the condenser. Additionally or alternatively, the feedback indicative of the pressure differential between the condenser and the evaporator may be based on a liquid level of refrigerant in the evaporator, a liquid level of refrigerant in the primary conduit, a pressure or temperature within the condenser, a pressure or temperature within the evaporator, an amount of power supplied to a compressor included in the vapor compression system, a speed of the compressor, a flow rate of refrigerant in the primary conduit, a flow rate of refrigerant in another portion of the vapor compression system, another suitable parameter, or any combination thereof. As such, the bypass conduit may be selectively fluidly coupled to the condenser and/or the primary conduit via the valve based on the feedback, which may improve the operating capacity, performance, and efficiency of the vapor compression system.

The control techniques of the present disclosure may be used in a variety of systems. However, to facilitate discussion, examples of systems that may incorporate the control techniques of the present disclosure are depicted in FIGS. 1-4, which are described hereinbelow.

Turning now to the drawings, FIG. 1 is a perspective view of an embodiment of an environment for a heating, ventilation, and air conditioning (HVAC) system 10 in a building 12 for a typical commercial setting. The HVAC system 10 may include a vapor compression system 14 that supplies a chilled liquid, which may be used to cool the building 12. The HVAC system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC system 10. The HVAC system 10 is shown with a separate air handler on each floor of building 12, but in other embodiments, the HVAC system 10 may include air handlers 22 and/or other components that may be shared between or among floors.

Figure 2:
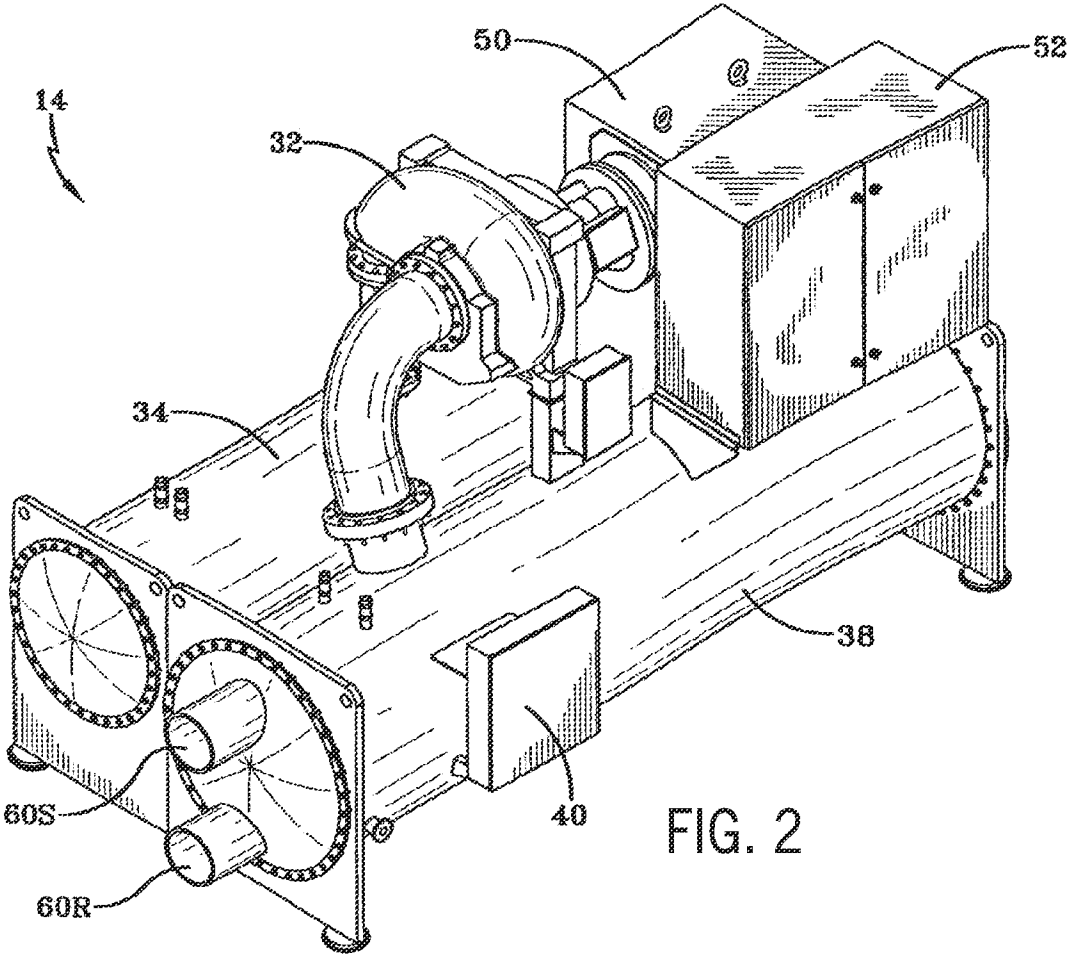
FIG. 2 is a perspective view of an embodiment of a vapor compression system, in accordance with an aspect of the present disclosure.
Figure 3:
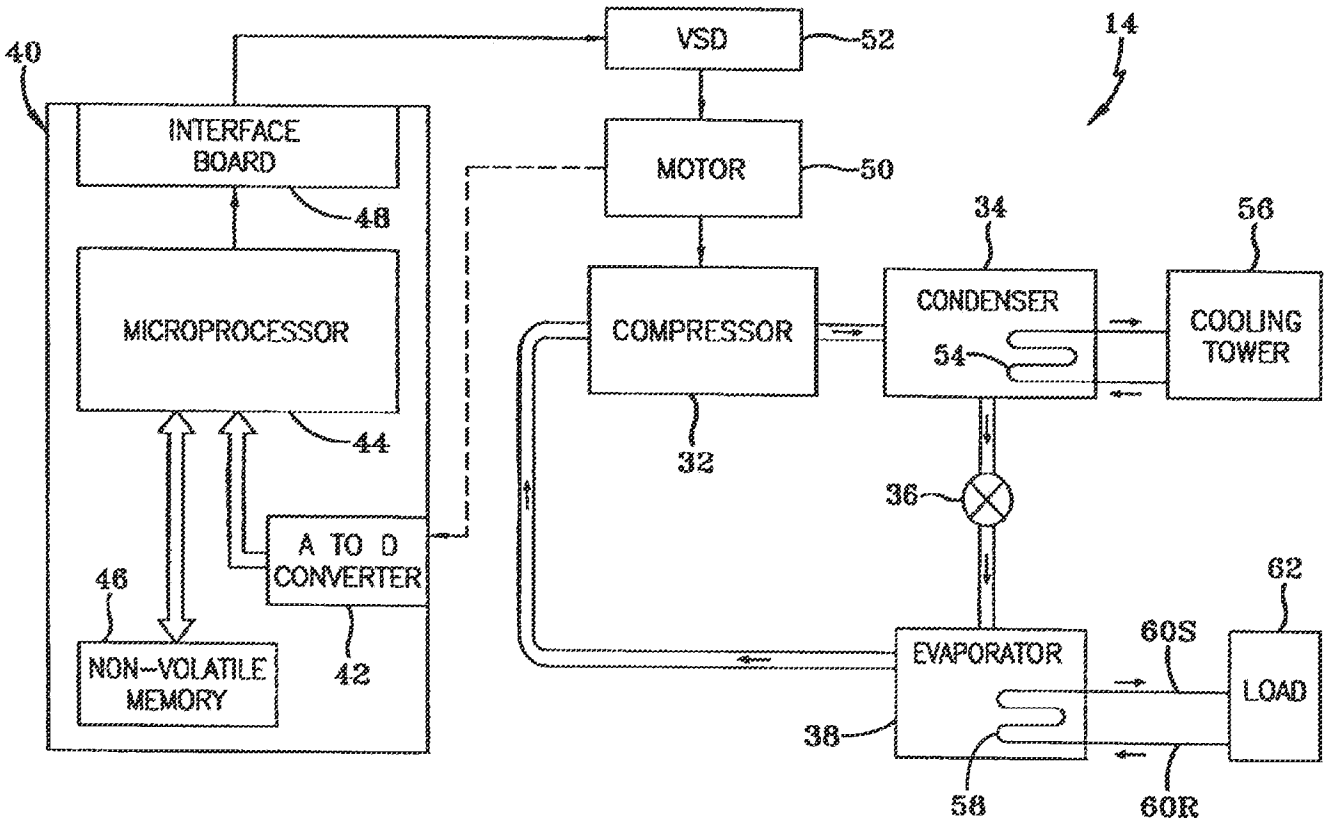
FIG. 3 is a schematic illustration of an embodiment of the vapor compression system, in accordance with an aspect of the present disclosure.

FIGS. 2 and 3 illustrate embodiments of the vapor compression system 14 that can be used in the HVAC system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
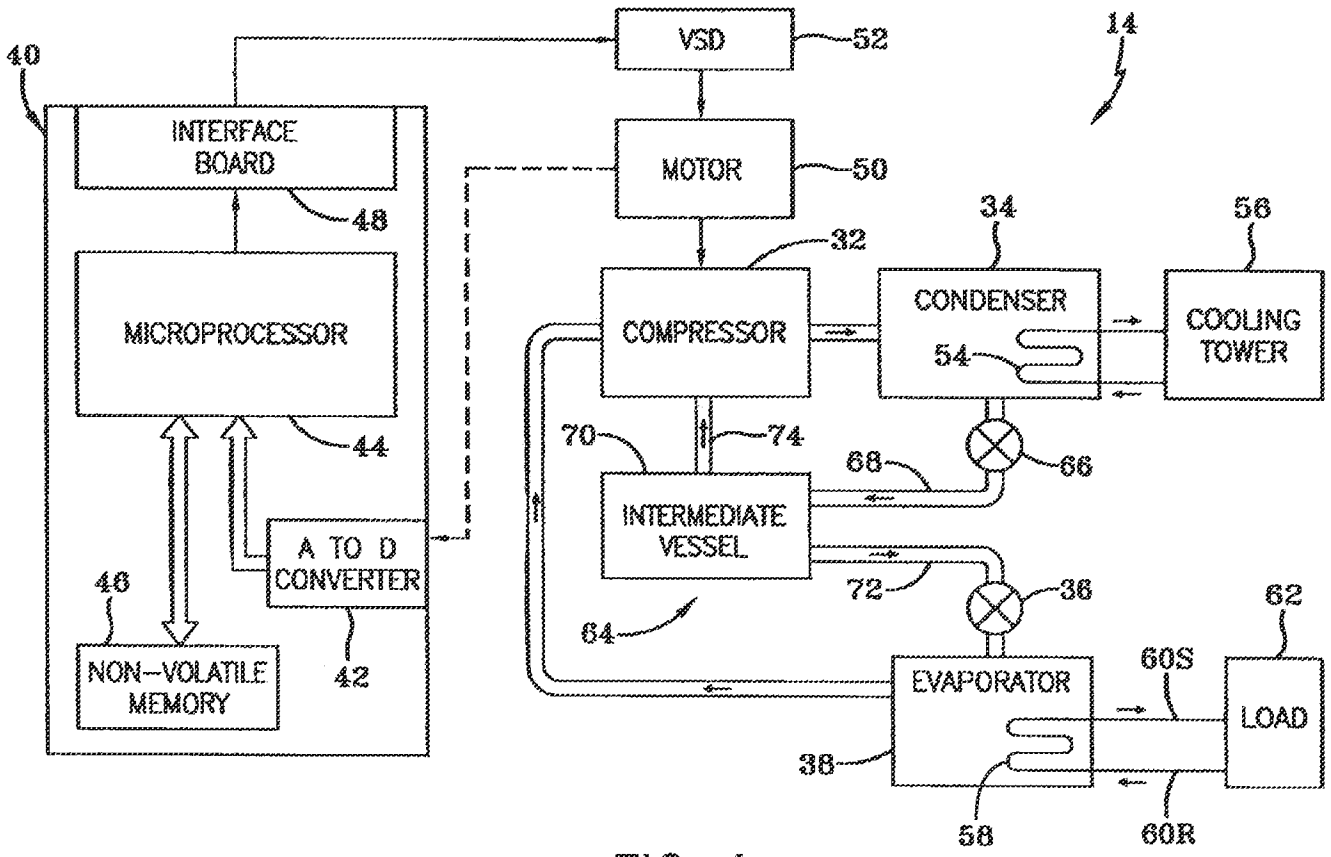
FIG. 4 is a schematic illustration of another embodiment of the vapor compression system, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

In some embodiments, it may be advantageous to include a bypass line within a vapor compression system to improve the efficiency of the vapor compression system, such as the vapor compression system 14. As discussed above, when a pressure differential in the vapor compression system 14 is relatively low, refrigerant may stack or accumulate in the condenser 34 and/or in a primary conduit between the condenser 34 and the evaporator 38, thereby limiting and/or restricting a flow of refrigerant between the condenser 34 and the evaporator 38. Accordingly, the bypass line may direct at least a portion of refrigerant along an alternative flow path (e.g., alternative from a flow path provided by the primary conduit) from the condenser 34 to the evaporator 38 that may include less resistance to flow than the primary conduit. In some embodiments, the bypass line directs the refrigerant toward a bottom portion of the evaporator 38, such that gravity may at least partially force the refrigerant from the condenser 34 to the evaporator 38. Additionally, a pressure head from liquid within the condenser 34 may also contribute to directing the refrigerant through the bypass line from the condenser 34 to the evaporator 38. Further, a control system, such as the control panel 40, may selectively actuate the bypass line to control a flow of the refrigerant from the condenser 34 to the evaporator 38. For example, the microprocessor 40 may actuate the bypass line based on a determination that stacking has occurred between the condenser 34 and the evaporator 38 and/or that a level of refrigerant in the condenser 34 and/or the evaporator 38 reaches a threshold level.

Figure 5:
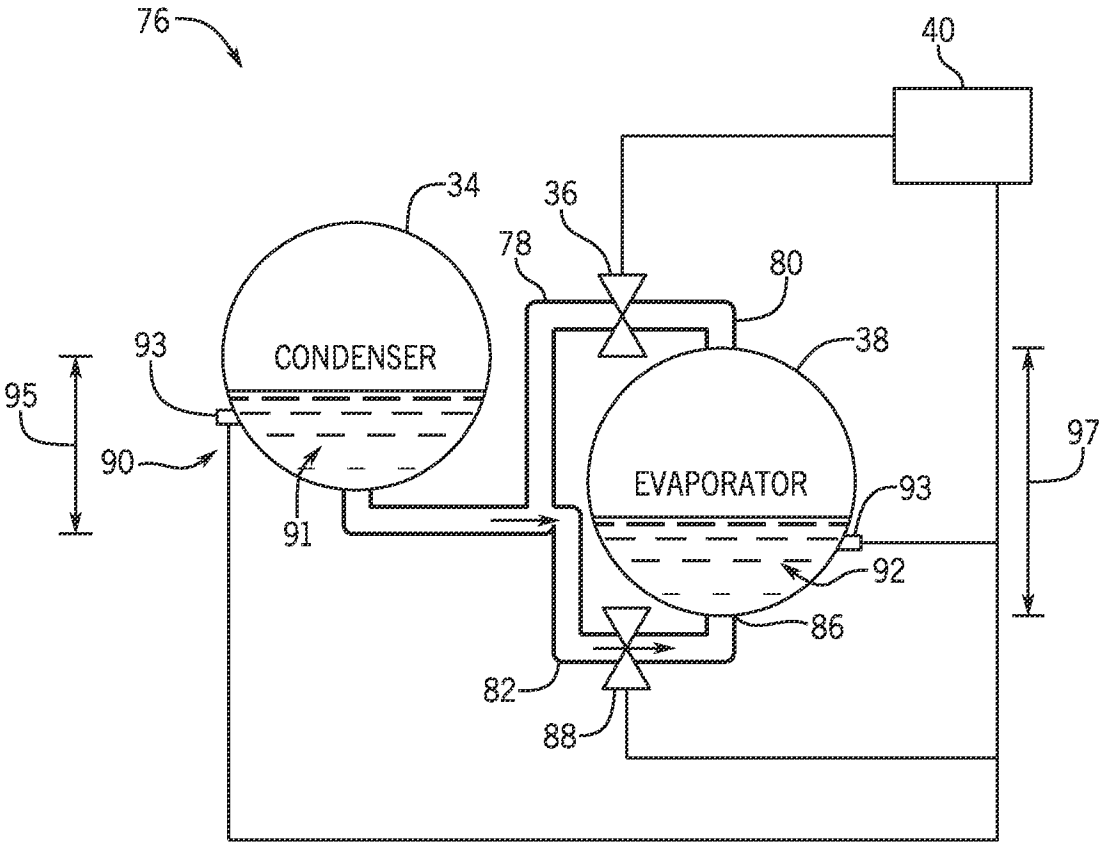
FIG. 5 is a schematic diagram of an embodiment of the vapor compression system having a bypass line, in an accordance with an aspect of the present disclosure.

FIG. 5 is a schematic diagram illustrating an embodiment of a circuit 76 (e.g., a portion of the vapor compression system 14) that may include one or more components controlled by the microprocessor 44 of the control panel 40 to enhance an efficiency of the vapor compression system 14. The circuit 76 includes the condenser 34 fluidly coupled to a top portion 80 of the evaporator 38 via a primary conduit 78. The primary conduit 78 may include the expansion device 36, which adjusts a flow of the refrigerant from the condenser 34 to the top portion 80 of the evaporator 38. The condenser 34 has a first fluid level 90 disposed in a liquid collection portion 91 of the condenser 34. For instance, the liquid collection portion 91 of the condenser 34 may be a portion of an interior of the condenser 34 that includes refrigerant in the liquid phase. In some embodiments, the liquid collection portion 91 of the condenser 34 may include at least 75% liquid refrigerant by volume, at least 90% liquid refrigerant by volume, at least 95% liquid refrigerant by volume, or at least 99% liquid refrigerant by volume. Additionally, as shown in the illustrated embodiment of FIG. 5, the evaporator 38 has a second fluid level 92, and one or both of the fluid levels 90 and 92 may be monitored by one or more liquid level probes 93.

As illustrated, the circuit 76 includes a secondary conduit 82 (e.g., a bypass conduit, a second conduit, a bypass line) that fluidly couples the condenser 34 to the evaporator 38 at a bottom portion 86 of the evaporator 38. While the illustrated embodiment of FIG. 5 shows the secondary conduit 82 as an extension from the primary conduit 78 (e.g., directly coupled to a portion of the primary conduit 78), in other embodiments, the secondary conduit 82 may be separate from the primary conduit 78. In other words, the secondary conduit 82 and the primary conduit 78 may both be physically coupled to the liquid collection portion 91 of the condenser 34. Also, the secondary conduit 82 includes a valve 88, which may regulate and/or selectively enable fluid flow through the secondary conduit 82 (e.g., the valve 88 may be communicatively coupled to the control panel 40), and thus, enable fluid flow from the condenser 34 to the evaporator 38.

In general, the secondary conduit 82 is a bypass for refrigerant that accumulates (e.g., stacks) in the primary conduit 78 and/or in the condenser 34. In other words, the secondary conduit 82 provides an additional flow path (e.g., a flow path at least partially distinct from a flow path defined by the primary conduit 78) for refrigerant to flow from the condenser 34 to the evaporator 38. The additional flow path provided by the secondary conduit 82 may include less resistance to refrigerant flow as compared to the primary conduit 78. For instance, the primary conduit 78 directs the refrigerant generally upward with respect to a vertical orientation 97 of the evaporator 38 toward the top portion 80 of the evaporator 38. The secondary conduit 82 directs the refrigerant generally downward with respect to the vertical orientation 97 of the evaporator 38 toward the bottom portion 86 of the evaporator 38. Thus, less fluid pressure or force is required for refrigerant to flow from the condenser 34 to the evaporator 38 along the secondary conduit 82 because the refrigerant may not flow against gravity in the secondary conduit 82.

Additionally or alternatively, a position of the condenser 34 may be above that of the evaporator 38 with respect to a base of the vapor compression system 14 that is positioned on a floor or the ground. As such, gravitational force directs the refrigerant from the condenser 34, through the secondary conduit 82, and into the evaporator 38 via the bottom portion 86 of the evaporator 38. Therefore, a height differential 95 between the condenser 34 and the evaporator 38 facilitates a flow of the refrigerant through the secondary conduit 82. Additionally, the liquid level 90 in the liquid collection portion 91 of the condenser 34 may create a pressure head that further directs the refrigerant through the secondary conduit 82 into the evaporator 38.

The evaporator 38 illustrated in FIG. 5 may be a hybrid falling-film and flooded evaporator. In some embodiments, the evaporator 38 may operate as a falling film evaporator, a flooded evaporator, or both. For example, the evaporator 38 may operate as a falling film evaporator when refrigerant flows through the primary conduit 78 and into the evaporator 38 via the top portion 80 of the evaporator 38. The evaporator 38 may include a first tube bundle that places a working fluid in thermal communication with refrigerant that falls from the top portion 80 of the evaporator 38 and over the tubes. Refrigerant contacting the first tube bundle may absorb thermal energy from the working fluid, which may cause at least some of the refrigerant directed into the evaporator 38 via the top portion 80 to evaporate (e.g., transition from a liquid phase to a vapor phase).

Additionally, the evaporator 38 may operate as a flooded evaporator when the refrigerant flows through the secondary conduit 82 and into the bottom portion 86 of the evaporator 38 (e.g., when a pressure differential between the condenser 34 and the evaporator 38 is relatively small). The evaporator 38 may include a second tube bundle that is surrounded by liquid refrigerant that accumulates in the bottom portion 86 of the evaporator. The second tube bundle may place the refrigerant in thermal communication with the working fluid, which may also flow through the second tube bundle. The liquid refrigerant surrounding the second tube bundle may then absorb thermal energy from the working fluid and evaporate (e.g., transition from the liquid phase to the vapor phase). Further still, the evaporator 38 may operate simultaneously as both the falling film evaporator and the flooded evaporator (e.g., a hybrid falling film evaporator, or a hybrid flooded evaporator, or a hybrid falling film and flooded evaporator) when the refrigerant flows through both the primary conduit 78 and the secondary conduit 82 into the top portion 80 and the bottom portion 86 of the evaporator 38, respectively. In other embodiments, the evaporator 38 may include another suitable type of evaporator instead of the hybrid falling film and flooded evaporator.

Figure 6:
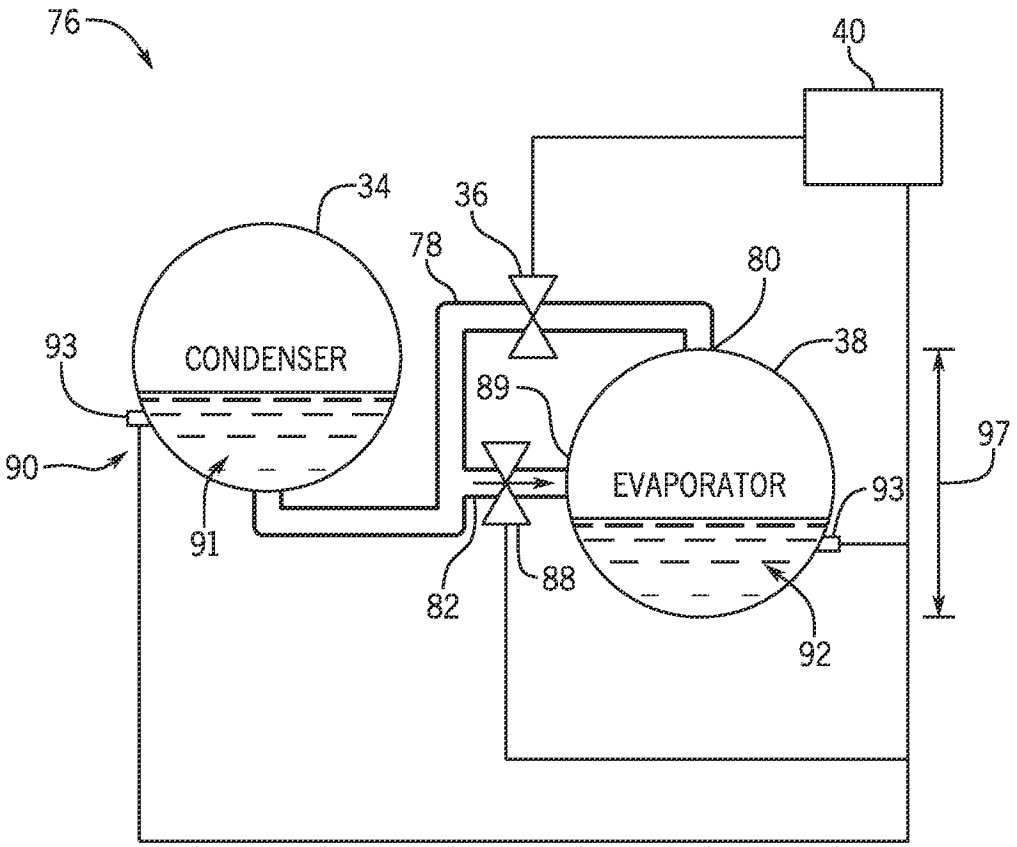
FIG. 6 is a schematic diagram of an embodiment of the vapor compression system having the bypass line, in an accordance with an aspect of the present disclosure.

FIG. 6 is a schematic diagram illustrating an embodiment of the circuit 76 (e.g., a portion of the vapor compression system 14) having the secondary conduit 82 coupled to the evaporator 38 at a side portion 94 of the evaporator 38. While the secondary conduit 82 is physically coupled to the evaporator 38 at the side portion 94 of the evaporator 38, the secondary conduit 82 still directs refrigerant into the bottom portion 86 of the evaporator 38 (e.g., liquid refrigerant falls into the bottom portion 86 via gravity). Accordingly, refrigerant directed into the evaporator 38 through the secondary conduit 82 enables the evaporator 38 to operate as a flooded evaporator because refrigerant flows into the bottom portion 86 of the evaporator 38 to surround the second tube bundle of the evaporator 28.

As shown in the illustrated embodiment of FIG. 6, the circuit 76 includes the condenser 34 fluidly coupled to the top portion 80 of the evaporator 38 via the primary conduit 78. The primary conduit 78 includes the expansion valve 36 that may adjust a flow of the refrigerant through the primary conduit 78. Additionally, as illustrated, the circuit 76 of FIG. 6 includes the secondary conduit 82 having the valve 88, which regulates and/or selectively enables refrigerant flow from the condenser 34 to the bottom portion 86 of the evaporator 38. As discussed above with reference to FIG. 5, the condenser 34 has the first liquid level 90, the evaporator 38 has the second liquid level 92, and one or both of the liquid levels 90 and 92 may be monitored by the liquid level probes 93.

The liquid level probes 93 may provide feedback to the control panel 40 (e.g., the microprocessor 44), which may be utilized to adjust positions of the expansion valve 36 and/or the valve 88. For instance, both the expansion valve 36 and the valve 88 are communicatively coupled to the microprocessor 44 of the control panel 40. As such, the microprocessor 44 may be configured to adjust a position of the expansion valve 36 and/or the valve 88 based on operating conditions of the circuit 76 (e.g., feedback indicative of a liquid level in the condenser 34 from the liquid level probe 93) regardless of the position of the secondary conduit 82 with respect to the evaporator 38 (e.g., coupled to the evaporator 38 at the bottom portion 86 or the side portion 94). The operation of the expansion valve 36 and the valve 88 may be adjusted based on signals received from the microprocessor 44 (e.g., from the one or more liquid level probes 93 and/or other suitable sensors). That is, the expansion valve 36 and the valve 88 may be opened and closed based on feedback indicative of a pressure differential between the condenser 34 and the evaporator 38. The feedback indicative of the pressure differential between the condenser 34 and the evaporator 38 may be based on a liquid level of refrigerant in the condenser 34, a liquid level of refrigerant in the evaporator 38, a liquid level of refrigerant in the primary conduit 78, a pressure or temperature within the condenser 34, a pressure or temperature within the evaporator 38, an amount of power supplied to a compressor (e.g., the compressor 32) included in the vapor compression system 14, a speed of the compressor (e.g., the compressor 32), a flow rate of refrigerant in the primary conduit 78, a flow rate of refrigerant in another portion of the vapor compression system 14, another suitable parameter, or any combination thereof. Control schemes for adjusting the positions of the expansion valve 36 and the valve 88 are discussed in further detail below with reference to FIG. 8.

Figure 7:
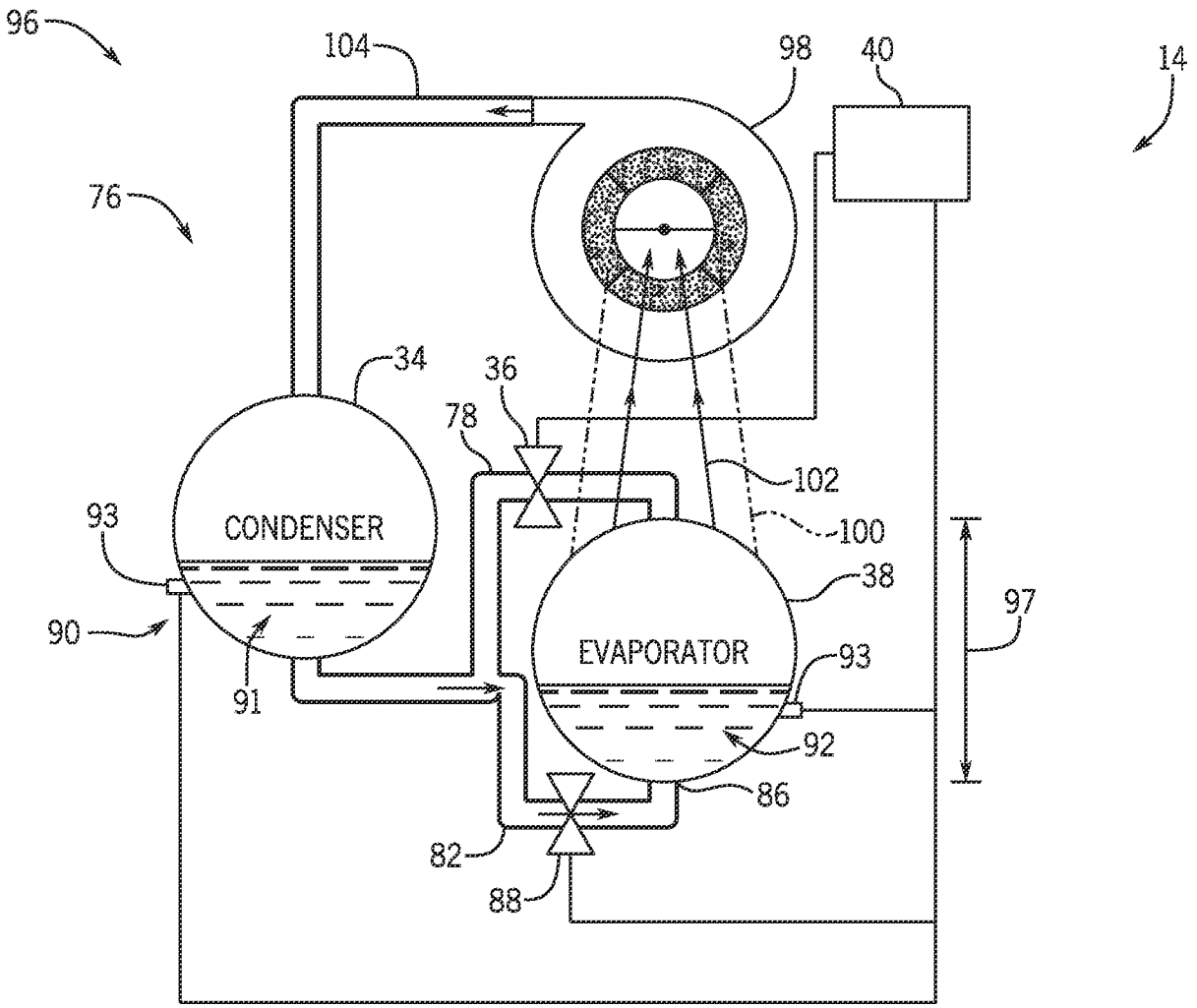
FIG. 7 is a schematic diagram of an embodiment of the vapor compression system having the bypass line, in an accordance with an aspect of the present disclosure.

FIG. 7 is a schematic diagram illustrating an embodiment of a free-cooling circuit 96 (e.g., a portion of the vapor compression system 14). In some embodiments, the circuit 76 is at least part of the free-cooling circuit 96. The vapor compression system 14 may utilize free-cooling to further improve an efficiency of the vapor compression system 14. As shown in the illustrated embodiment of FIG. 7, the free-cooling circuit 96 includes the condenser 34 fluidly coupled to the top portion 80 of the evaporator 38 via the primary conduit 78. The primary conduit 78 includes the expansion valve 36, which may adjust a flow of the refrigerant directed into the evaporator 38 via the primary conduit 78. The condenser 34 has the first liquid level 90, the evaporator 38 has the second liquid level 92, and one or both of the liquid levels 90 and 92 may be monitored by the liquid level probes 93. As illustrated in FIG. 7, the secondary conduit 82 is physically coupled to the bottom portion 86 of the evaporator 38. In other embodiments, the secondary conduit 82 may be physically coupled to the side portion 94 of the evaporator 38. In any case, the refrigerant flowing through the secondary conduit 82 may be directed into the bottom portion 86 of the evaporator 38. Also, the secondary conduit 82 includes the valve 88, which regulates and/or selectively enables refrigerant flow from the condenser 34 to the evaporator 38 via the secondary conduit 82.

The free-cooling circuit 96 also includes a compressor 98 (e.g., the compressor 32) fluidly coupled to the evaporator 38 via a third conduit 100. As shown, the compressor 98 is configured to draw a flow 102 of refrigerant (e.g., vapor refrigerant) from the evaporator 38 and direct the flow 102 of refrigerant to the condenser 34. While the compressor 98 is not illustrated in FIGS. 5 and 6, it should be recognized that the circuit 76 of FIGS. 5 and 6 may also include the compressor 98.

During free-cooling conditions (e.g., when ambient temperature falls below a threshold value), the compressor 98 may be turned off or may run at a lower capacity than in normal operation (e.g., when ambient temperature is at or above the threshold value). The bypass line (e.g., the secondary conduit 82) may facilitate operation of the free-cooling circuit 96 by providing a pathway for liquid refrigerant to reach the evaporator 38 without mechanical force (e.g., a pressure differential created via the compressor 98 and/or a pump). For example, vapor refrigerant may flow from the evaporator 38, through the third conduit 100, through the compressor 98, through a fourth conduit 104, and into the condenser 34 via a pressure differential and/or temperature differential between the evaporator 38 and the condenser 34. The vapor refrigerant then condenses to liquid and collects in the liquid collection portion 91 of the condenser 34. Further, when the valve 88 is adjusted toward an open position, the bypass line (e.g., the secondary conduit 82) enables the liquid refrigerant to flow from the condenser 34 to the evaporator 38 via gravitational force (and/or pressure head from the liquid collected in the liquid collection portion 91 of the condenser 34). As such, mechanical forces, such as the compressor 98 and/or a pump, are not utilized during free cooling and power input is reduced.

Figure 8:
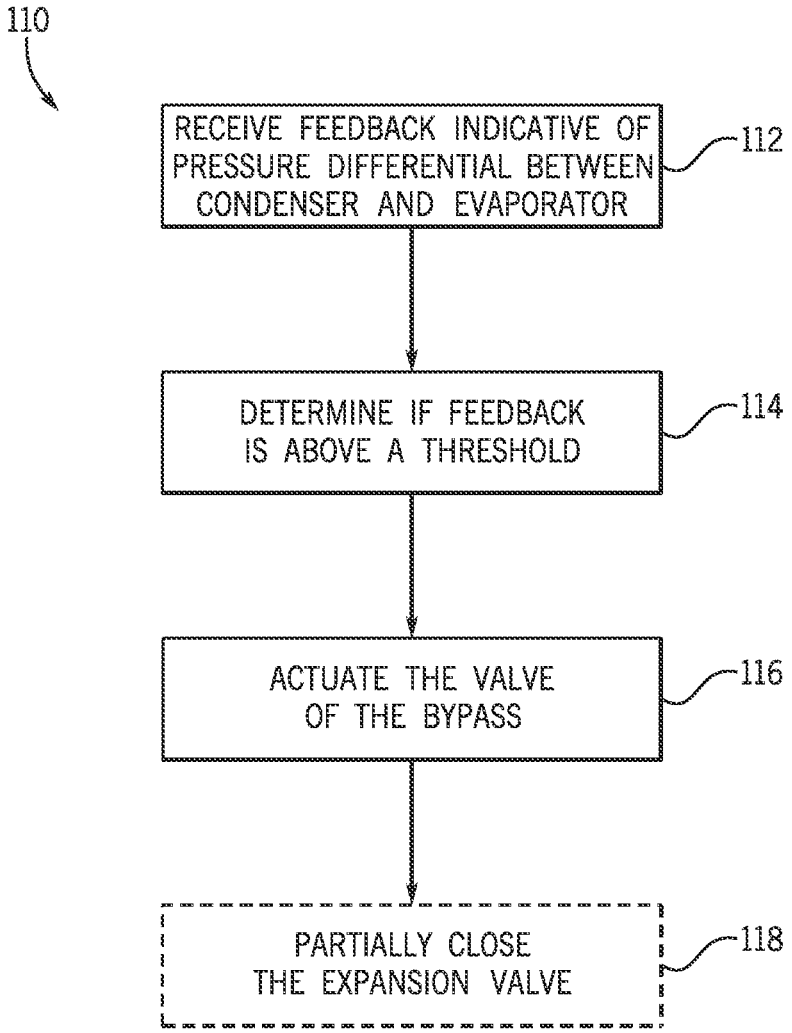
FIG. 8 is a flow chart representing an embodiment of a process for operating the vapor compression system, in accordance with an aspect of the present disclosure.

FIG. 8 is a flow chart illustrating an embodiment of a process 110 for operating the valve 36 and/or the valve 88 of the circuit 76 and/or the free-cooling circuit 96, in accordance with aspects of the present disclosure. It is to be understood that the steps discussed herein are merely exemplary, and certain steps may be omitted or performed in a different order than the order described below. In some embodiments, the process 110 may be stored in the non-volatile memory 46 and executed by the microprocessor 44 of the control panel 40 or stored in other suitable memory and executed by other suitable processing circuitry.

As shown in the illustrated embodiment of FIG. 8, at block 112, the microprocessor 44 receives feedback indicative of a pressure differential between the condenser 34 and the evaporator 38. The feedback indicative of the pressure differential between the condenser 34 and the evaporator 38 may be a liquid level of refrigerant in the condenser 34, a liquid level of refrigerant in the evaporator 38, a liquid level of refrigerant in the primary conduit 78, a pressure or temperature within the condenser 34, a pressure or temperature within the evaporator 38, an amount of power supplied to a compressor (e.g., the compressor 32) included in the vapor compression system 14, a speed of the compressor (e.g., the compressor 32), a flow rate of refrigerant in the primary conduit 78, a flow rate of refrigerant in another portion of the vapor compression system 14, another suitable parameter, or any combination thereof. In other embodiments, the microprocessor 44 may receive feedback related to any parameter indicative of the performance or capacity of the vapor compression system 14 or the phase of the refrigerant.

At block 114, the microprocessor 44 may compare the feedback to a threshold. For example, the microprocessor 44 may determine that a liquid level of the refrigerant in the condenser 34 is above a threshold level. As such, at block 116, the microprocessor 44 may send a control signal to actuate (e.g., partially or completely open) the valve 88 to fluidly couple the condenser 34 (and/or the primary conduit 78) to the evaporator 38 via the secondary conduit 82. The valve 88 may be a step valve, a solenoid valve, a continuous modulating valve, or any suitable valve. In general, the microprocessor 44 may regulate operation of the vapor compression system 14 based on the feedback indicative of the pressure differential between the condenser 34 and the evaporator 38 and/or another suitable operating parameter.

In some embodiments, the microprocessor 44 may determine a position of the expansion valve 36 before actuating the valve 88. For example, the microprocessor 44 may determine that the expansion valve 36 is not completely open. As such, rather than the microprocessor 44 sending a control signal to open the valve 88, the microprocessor 44 may send a control signal to continue actuating (e.g., opening or incrementally opening) the expansion valve 36. This process may repeat until the valve 36 is in a fully open position. Once the expansion valve 36 is in the fully open position, or reaches another suitable threshold position, the microprocessor 44 may send a control signal to actuate (e.g., open) the valve 88. In other words, the microprocessor 44 may not send a control signal to open the valve 88 until the expansion valve 36 is completely opened or sufficiently opened (e.g., opened such that the feedback indicative of the pressure differential between the condenser 34 and the evaporator 38 is at or below a certain threshold). In some embodiments, the microprocessor 44 may send a control signal to open the valve 88 before the feedback indicative of the pressure differential between the condenser 34 and the evaporator 38 reaches the threshold. For example, the microprocessor 44 may send a control signal to actuate (e.g., open) the valve 88 when the feedback indicative of the pressure differential between the condenser 34 and the evaporator 38 reaches 80% of the threshold.

In some embodiments, the microprocessor 44 may send a control signal to actuate (e.g., close) the expansion valve 36 when the microprocessor 44 determines that the valve 88 should be opened. For example, before or after the valve 88 is actuated (e.g., adjusted toward an open position via a control signal from the microprocessor 44), the expansion valve 36 may be partially closed (e.g., 50%) or fully closed. The microprocessor 44 may then send a control signal to actuate (e.g., open) the valve 88.

In some embodiments, the microprocessor 44 is configured to open the valve 88 incrementally based on the feedback indicative of the pressure differential between the condenser 34 and the evaporator 38. For example, the valve 88 may be a step valve having a plurality of positions between a fully open position and a fully closed position. As such, the microprocessor 44 may adjust a position of the valve 88 to incrementally increase or decrease a flow of the refrigerant through the secondary conduit 82.

As a non-limiting example, the microprocessor 44 may receive feedback from the liquid level sensor 93 configured to monitor the liquid level 90 in the condenser 34. The microprocessor 44 may receive feedback that the liquid level 90 in the condenser 34 has exceeded a threshold programmed in the non-volatile memory 46 of the control panel 40. As such, the microprocessor 44 may send a signal to the valve 88 (e.g., an actuator of the valve 88) to adjust the valve 88 toward an open position. As set forth above, in some embodiments, the microprocessor 44 may determine a position of the expansion valve 36 and adjust a position of the valve 88 based on the position of the expansion valve 36. Additionally or alternatively, the microprocessor 44 may send an additional control signal to the expansion valve 36 (e.g., an actuator of the expansion valve 36) to adjust the expansion valve 36 toward a closed position when the liquid level 90 in the condenser 34 exceeds the threshold. In other embodiments, the microprocessor 44 may adjust the expansion valve 36 toward an open position upon opening the valve 88 in order to account for a lag time in refrigerant flow to the evaporator 38 via the secondary conduit 82 (e.g., a lag time between opening the valve 88 and a flow of refrigerant entering the evaporator 38 via the secondary conduit 82). Further still, the microprocessor 44 may modulate both the expansion valve 36 and the valve 88 based on the liquid level 90 in the condenser 34 in order to maintain the liquid level 90 at a target level. For instance, the microprocessor 44 may continuously, or substantially continuously, adjust the position of the expansion valve 36, the valve 88, or both, to maintain the liquid level 90 in the condenser 34 at the target level.

The present disclosure is directed to a vapor compression system that includes a bypass line between the condenser and the evaporator. The bypass line may selectively fluidly couple the condenser to the evaporator via a flow path having relatively little resistance based on feedback indicative of a pressure differential between the condenser and the evaporator. When the bypass line fluidly couples the condenser to the evaporator, a flow of refrigerant from the condenser to the evaporator may be facilitated because the flow path having relatively little resistance may utilize gravitational force to direct the refrigerant from the condenser to the evaporator. For example, the flow path formed by the bypass line may be generally aligned in a downward direction from the condenser to the evaporator. In some embodiments, the bypass line may connect to a side or a bottom portion of the evaporator. In any case, refrigerant flowing into the evaporator via the bypass line is directed toward, and accumulates in, the bottom portion of the evaporator.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system, comprising:

a first conduit fluidly coupling a liquid collection portion of a condenser and an evaporator, wherein the first conduit is configured to direct a first flow of refrigerant from the condenser to a first inlet of the evaporator; and a second conduit fluidly coupling the liquid collection portion of the condenser and the evaporator, wherein the second conduit is configured to direct a second flow of refrigerant from the condenser to a second inlet of the evaporator via gravitational force, wherein the first conduit and the second conduit are directly coupled to one another, and wherein the first inlet is disposed above the second inlet relative to a vertical dimension of the evaporator.

2. The vapor compression system of claim 1, wherein the liquid collection portion of the condenser comprises a portion of an interior of the condenser that comprises refrigerant in a liquid phase.

3. The vapor compression system of claim 1, comprising:

a valve disposed along the second conduit; and a controller configured to adjust a position of the valve based on feedback indicative of a pressure differential between the condenser and the evaporator.

4. The vapor compression system of claim 3, wherein the feedback indicative of the pressure differential between the condenser and the evaporator comprises a liquid level in the liquid collection portion of the condenser.

5. The vapor compression system of claim 4, wherein the controller is configured to adjust the position of the valve toward an open position when the liquid level in the liquid collection portion of the condenser is greater than or equal to a threshold value.

6. The vapor compression system of claim 1, comprising the evaporator, wherein the evaporator is a hybrid falling film evaporator.

7. The vapor compression system of claim 6, wherein the first conduit is configured to couple to a top portion of the hybrid falling film evaporator, wherein the second conduit is configured to couple to a bottom portion of the hybrid falling film evaporator, and wherein the bottom portion is disposed below the top portion relative to the vertical dimension of the evaporator.

8. The vapor compression system of claim 1, comprising a valve disposed along the first conduit.

9. The vapor compression system of claim 8, comprising a controller that is configured to adjust the valve toward a closed position when a liquid level in the liquid collection portion of the condenser is less than or equal to a threshold value.

10. A vapor compression system, comprising:

a condenser configured to receive a refrigerant of the vapor compression system and place the refrigerant in a heat exchange relationship with a first working fluid;

an evaporator configured to place the refrigerant in a heat exchange relationship with a second working fluid;

a primary conduit connected to the evaporator and fluidly coupling the evaporator to the condenser;

a bypass conduit connected to the evaporator and fluidly coupling the evaporator to the condenser;

a valve disposed along the bypass conduit; and a controller configured to adjust a position of the valve based on feedback indicative of a pressure differential between the condenser and the evaporator.

11. The vapor compression system of claim 10, wherein the primary conduit and the bypass conduit are directly coupled to one another.

12. The vapor compression system of claim 10, wherein the primary conduit extends between the condenser and the evaporator, and the bypass conduit extends between the primary conduit and the evaporator.

13. The vapor compression system of claim 10, wherein the primary conduit is connected to the evaporator at a top portion relative to a vertical dimension of the evaporator, and wherein the bypass conduit is connected to the evaporator at a location below the top portion relative to the vertical dimension of the evaporator.

14. A vapor compression system, comprising:

a condenser configured to receive a refrigerant from a compressor in a gaseous phase, wherein the condenser is configured to condense the refrigerant from the gaseous phase into a liquid phase via heat transfer from the refrigerant to a first working fluid;

an evaporator fluidly coupled to the condenser via a first conduit and via a second conduit, wherein the evaporator is configured to vaporize the refrigerant from the liquid phase into the gaseous phase via heat transfer from a second working fluid to the refrigerant; and a controller configured to regulate operation of the vapor compression system to direct the refrigerant into the evaporator via the first conduit, the second conduit, or both when a liquid refrigerant level in the condenser is outside of a threshold range of values.

15. The vapor compression system of claim 14, wherein the first conduit and the second conduit are both coupled to a liquid collection portion of the condenser.

16. The vapor compression system of claim 14, comprising a first valve communicatively coupled to the controller, wherein the controller is configured to adjust a position of the first valve to control a first flow of the refrigerant from the condenser to the evaporator through the first conduit based on the liquid refrigerant level in the condenser.

17. The vapor compression system of claim 16, comprising a second valve communicatively coupled to the controller, wherein the controller is configured to adjust a position of the second valve to control a second flow of the refrigerant from the condenser to the evaporator through the second conduit based on the liquid refrigerant level in the condenser.

18. The vapor compression system of claim 14, wherein the evaporator is a hybrid falling film evaporator.

19. The vapor compression system of claim 14, wherein the compressor is configured to circulate the refrigerant between the condenser and the evaporator, wherein the controller is communicatively coupled to the compressor, and wherein the controller is configured to shut down the compressor when an ambient temperature falls below a threshold ambient temperature.

* * * * *